United States Patent [19]

Pryor et al.

[11] 3,942,688

[45] Mar. 9, 1976

[54] POST-MIX VENDOR SYRUP TANK

[75] Inventors: Harry H. Pryor, St. Louis; James J. Schinker, Hazelwood, both of Mo.

[73] Assignee: UMC Industries, Inc., New York, N.Y.

[22] Filed: June 27, 1974

[21] Appl. No.: 483,874

[52] U.S. Cl. ..... 222/108; 222/464

[51] Int. Cl.[2] ..... B67D 1/16; B67D 5/60

[58] Field of Search ..... 222/108, 109, 464; 126/384, 385, 386

[56] References Cited

UNITED STATES PATENTS

| | | | |
|---|---|---|---|
| 1,627,099 | 5/1927 | Landgren et al. | 126/385 |
| 2,079,281 | 5/1937 | Duarte | 126/385 |
| 3,369,710 | 2/1968 | Lucas | 222/109 |

FOREIGN PATENTS OR APPLICATIONS

| | | | |
|---|---|---|---|
| 316,854 | 9/1929 | United Kingdom | 126/385 |

*Primary Examiner*—Allen N. Knowles
*Assistant Examiner*—Hadd Lane
*Attorney, Agent, or Firm*—Koenig, Senniger, Powers and Leavitt

[57] ABSTRACT

A syrup tank for a post-mix carbonated beverage vendor comprising a container open at the top and a removable cover having an opening for pouring syrup into the container, the cover having flanges forming a channel surrounding the pouring opening for collecting liquid being poured which misses the opening to prevent it from running down on the outside of the container to the floor, with an auxiliary cover member separate from said cover carrying a syrup pick-up tube extending down into the container.

9 Claims, 9 Drawing Figures

POST-MIX VENDOR SYRUP TANK

BACKGROUND OF THE INVENTION

This invention relates to tanks, and more particularly to a syrup tank for a post-mix carbonated beverage vendor.

The invention is especially concerned with a syrup tank of the class described meeting the requirements of Section 406 entitled "Non-Pressurized Food Containers" of the present Health and Sanitization Evaluation Manual Code of the National Automatic Merchanidising Association. Such tanks are used in post-mix vendors, a number of such tanks usually being provided in the cabinet of a vendor on the floor of the cabinet in a single row side-by-side, sometimes in two rows. Tanks such as used at present generally comprise a container of relatively long and narrow rectangular shape in plan having a removable cover with a circular pouring opening in the cover, a flange extending up around the opening, and a lid fitting on the flange. Also, meeting the above-noted Code, the cover is generally shaped so that any syrup being poured into the container which misses the pouring opening will run off the cover or down the sides of the container onto the floor. Even if the routeman is sufficiently diligent to endeavor to clean up the tanks and floor, his task is difficult because of the difficulty of removing the tanks for clean-up, noting that a filled tank may weigh as much as 60 pounds, making it difficult to remove it, clean it and replace it in the cabinet, in addition to which removal is prone to cause sloshing and spilling of syrup.

SUMMARY OF THE INVENTION

Accordingly, among the several objects of this invention may be noted the provision of an improved tank of the class described which simplifies the clean-up problem attendant upon pouring syrup into the tank; and the provision of such a tank which reduces the possibility of spillage when pouring syrup into the tank.

In general, a tank of this invention comprises a container open at the top and a cover for the top having an opening therein for pouring a liquid (e.g., syrup) into the container, the cover also being formed with a channel surrounding said opening for collecting liquid being poured which misses said opening to prevent such spillage from running down the outside of the container to the floor, and said cover being removable from the container for pouring out the collected spillage and cleaning the cover.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 2:
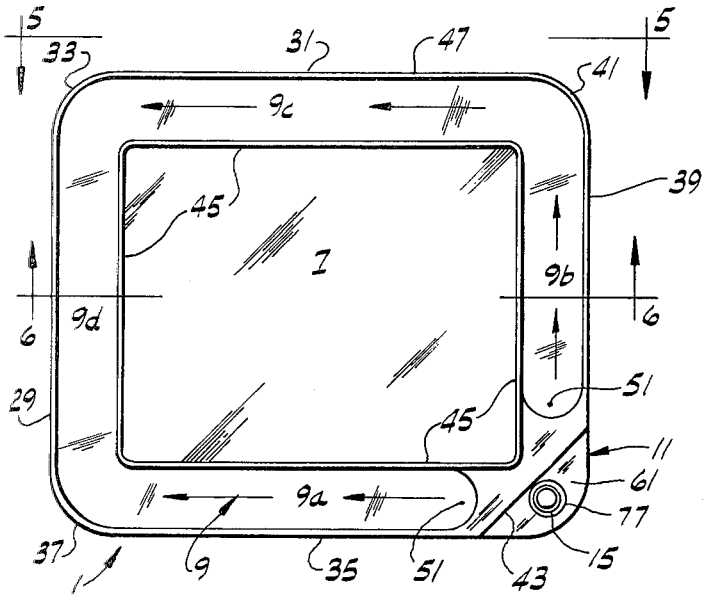
FIG. 2 is a plan of the FIG. 1 tank with a lid removed.
Figure 1:
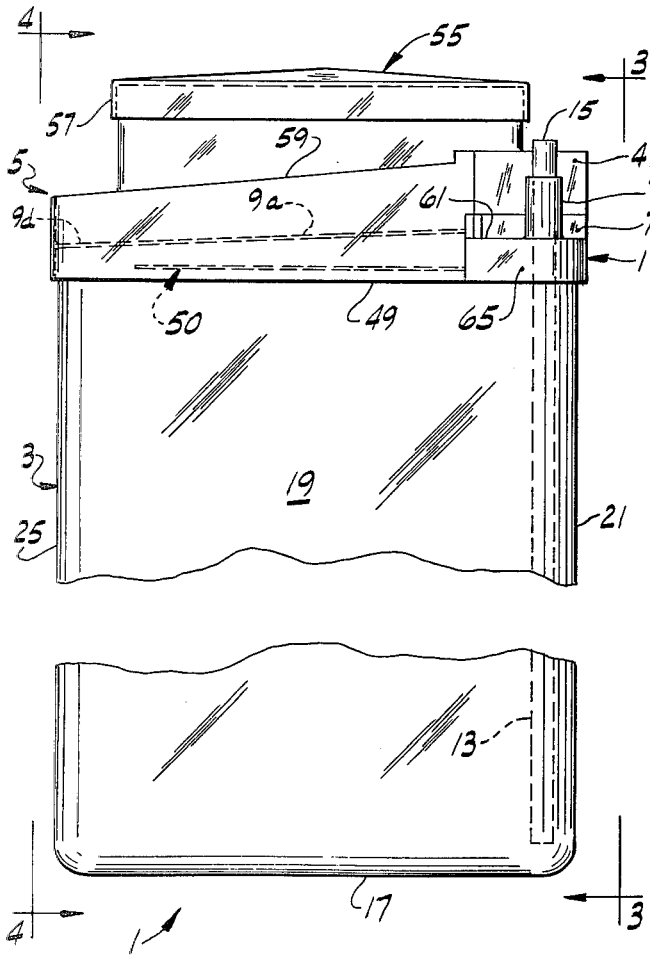
FIG. 1 is a view in elevation of one side of a tank of this invention.
Figure 3:
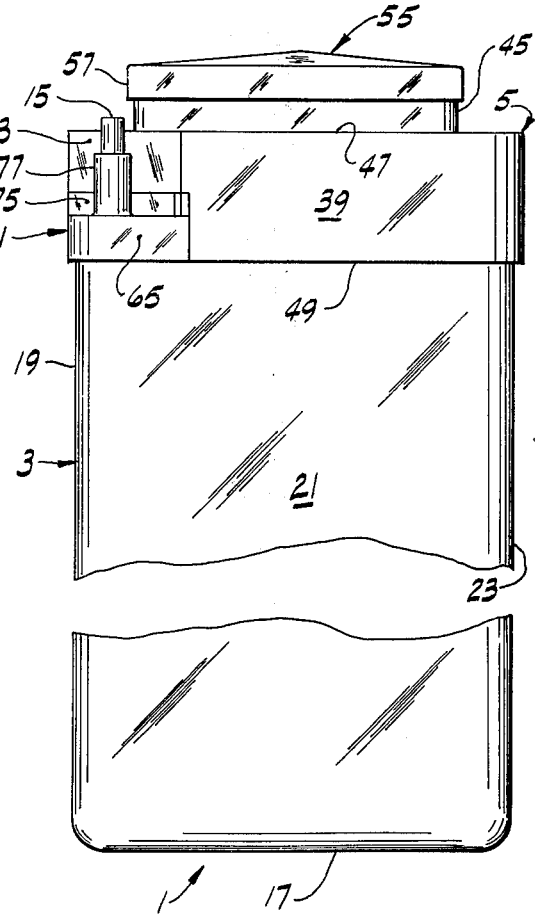
FIG. 3 is a view in elevation of the right side of the FIG. 1 tank, taken on line 3—3 of FIG. 1.
Figure 4:
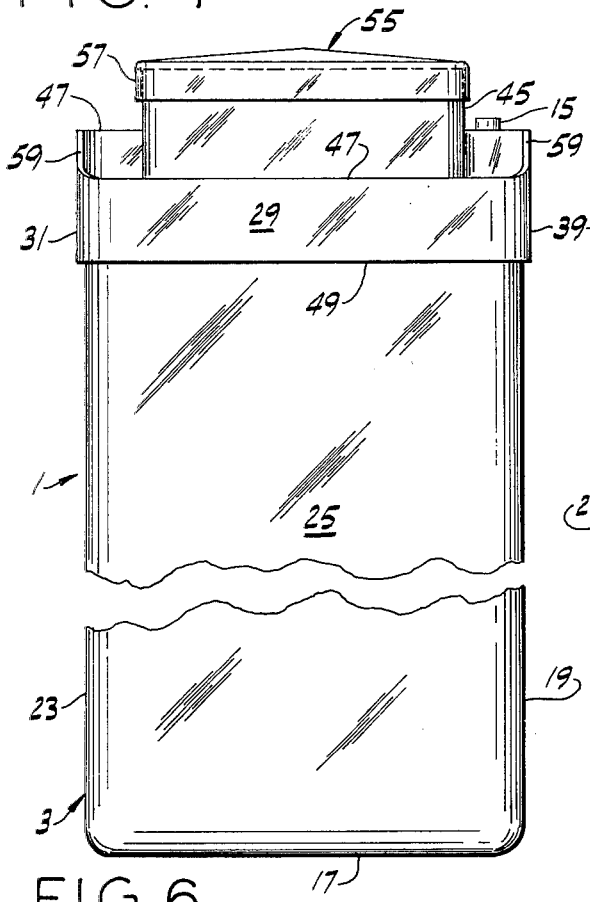
FIG. 4 is a view in elevation of the left side of the FIG. 1 tank, taken on line 4—4 of FIG. 1.
Figure 5:
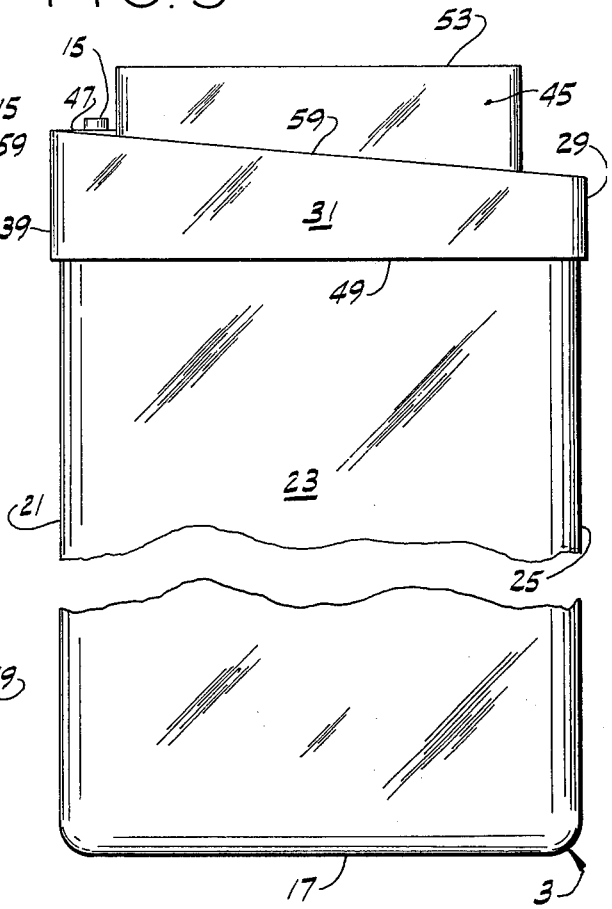
FIG. 5 is a view in elevation of the FIG. 1 tank taken on iine 5—5 of FIG. 2.
Figure 6:
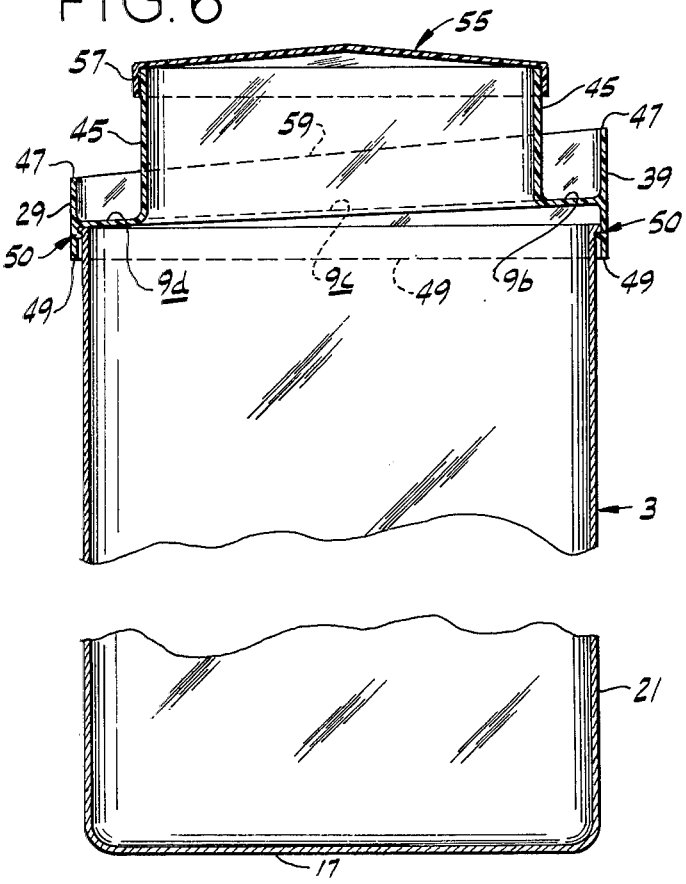
FIG. 6 is a vertical section on line 6—6 of FIG. 2, showing the lid in place.
Figure 7:
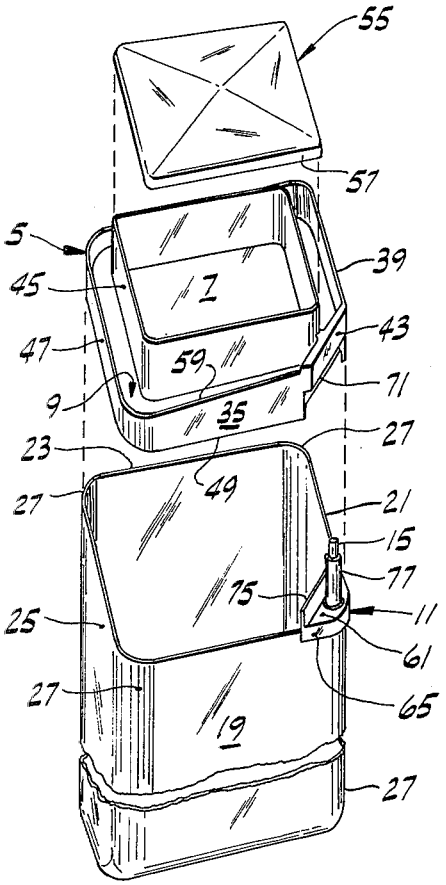
FIG. 7 is an exploded perspective.
Figure 8:
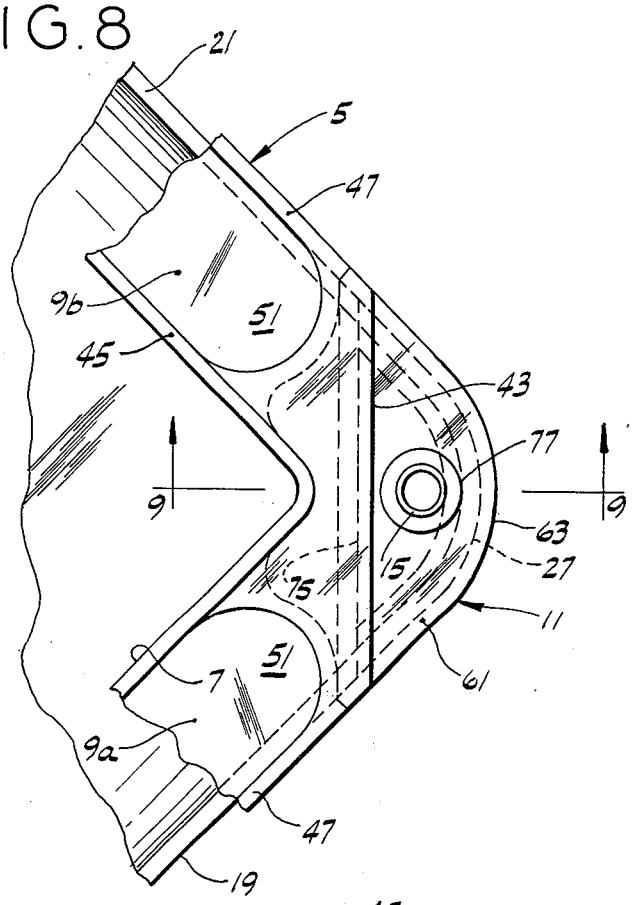
FIG. 8 is an enlarged fragment of FIG. 2.
Figure 9:
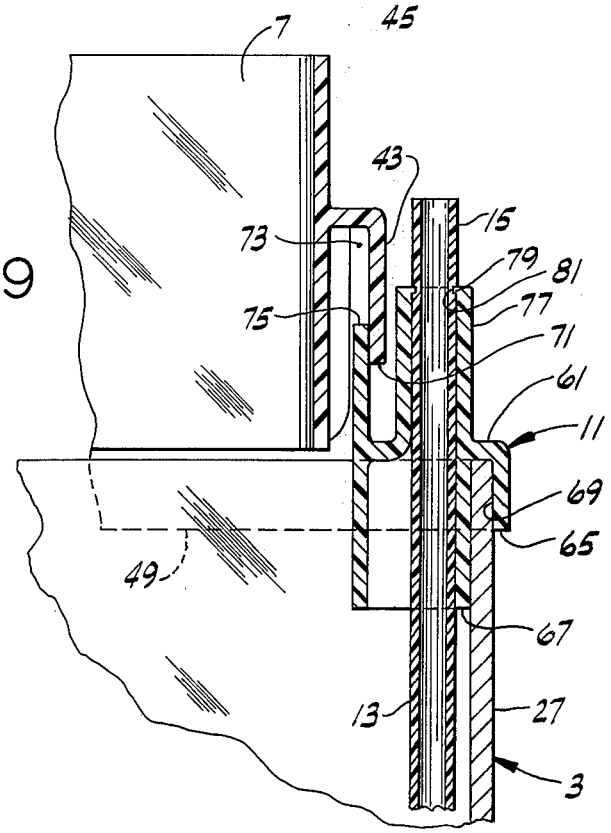
FIG. 9 is a section on line 9—9 of FIG. 8.

Referring to the drawings, a tank of this invention, designated in its entirety by the reference numeral 1, is shown to comprise a container 3 open at the top and a cover 5 for the top of the container having an opening 7 therein for pouring a liquid (e.g., syrup) into the container. The cover is also formed with a channel 9 surrounding the opening 7 for collecting liquid being poured which misses the opening to prevent such spillage from running down the outside of the container to the floor on which the container stands. The cover is removable from the container for pouring out the collected spillage and cleaning the cover. The channel 9 is shaped for flow of liquid collected in the channel to a low zone of the channel. The cover 5 covers part of the top of the container and constitutes the main cover of the tank, the remainder of the top of the container being covered by an auxiliary cover member 11 having a pick-up tube 13 extending downwardly therefrom into the container, having means 15 constituted by the upper end of the tube for connecting a line (not shown) to the tube for drawing liquid (e.g., syrup) out of the container. This auxiliary cover member 11 along with the pick-up tube is removable from the container, and the main cover 5 is removable without removing the auxiliary cover member.

The container 3 is rectangular in plan, having a rectangular bottom 17 and four sides 19, 21, 23 and 25 with rounded vertical corners 27. It is preferably molded of polypropylene, although the material from which it is made is not at all critical. The main cover 5, which may be molded of the same material as the container, is pentagonal, having two sides 29 and 31 at right angles to one another meeting at a rounded corner 33, these two sides matching sides 25 and 23 of the container, a third side 35 at right angles to side 29 meeting it at a rounded corner 37, and a fourth side 39 at right angles to side 31 meeting it at a rounded corner 41. Sides 35 and 39 match sides 19 and 21 of the container. At 43 is indicated the fifth side extending between the ends of sides 35 and 39. The opening 7 in the cover is rectangular and relatively large in relation to the side of the cover. The channel 9 surrounding the opening 7 is formed by an inner flange 45 extending up from the cover around the opening and an outer flange 47 extending up from the cover all around at its periphery. The cover has a flange 49 extending downwardly therefrom at its periphery along sides 29, 31, 35 and 39, this flange 49 having a telescoping sliding fit on the outside of the sides of the container. Flanges 47 and 49 are coplanar at the periphery of the cover. The container and cover may have snap-fit means as indicated at 50.

As noted above, the channel 9 is sloped; in this regard, it has bottom portions *9a–9d* at sides 35, 39, 31 and 29, respectively. Bottom portion *9a* and bottom portions *9b* and *9c* slope down from high points 51 of the bottom of the channel at the side 43 of the cover to the ends of bottom portion *9d*, which is the low zone of the channel, and which is generally level from end-to-end. It is to be noted that portion *9d* is at a side of the cover away from the corner occupied by the auxiliary cover member 11.

The inner flange 45 of the cover is higher than the outer flange 47 to preclude liquid collected in the channel 9 from spilling over into the container 3. The upper edge 53 of the inner flange of the cover is horizontal all the way around. At 55 is indicated a lid fitting on the inner flange 45, the lid having a downwardly extending peripheral flange 57 which has a telescoping sliding fit on the outside of the inner flange 45. The upper edge of the outer flange 47 may be sloped as indicated at 59 on sides 31 and 35 of the cover down to the side 29.

The auxiliary cover member 11, which may be molded of the same material as the container, has a flat body portion 61 generally of triangular outline in plan with the two legs of the triangular outline at right angles and meeting at a rounded corner 63 corresponding to the rounding of the vertical corners 27 of the container 3. Member 11 fits removably on top of the container at a corner of the container (the corner at the juncture of sides 19 and 21 as shown). It has a flange 65 extending down along its two legs and a flange 67 on the inside of flange 65 forming a groove 69 for receiving said corner of the container with a telescopic fit. The side 43 of the cover 5 is inset at its bottom as indicated at 71 and the cover has a recess 73 at side 43 opening downwardly to this inset for receiving a flat flange 75 extending up from the body 61 at the base (hypotenuse) of its triangular outline. The auxiliary cover member 11 has a tubular boss 77 extending up from the body 61 thereof.

Pick-up tube 13 is secured in this boss as by having an annular groove 79 receiving an internal annular bead 81 at the upper end of the boss, and extends down from the boss into the container 3. An upwardly extending portion of the tube constitutes the means 15 for connecting the syrup line (not shown).

The tank 1 as above described is particularly for use as a syrup tank in a post-mix carbonated beverage vendor. It will be understood that such a vendor will have a plurality of the tanks 1 placed therein for holding different flavors, the tanks usually being arranged side-by-side in a row. Each tank is preferably placed in the vendor with its side 25 (and hence the low zone **9*d* of channel 9) toward the front. Syrup lines (not shown) are connected between the upper ends 15 of the syrup tubes 13** of the tanks and the usual syrup pumps on the vendor.

A tank may be filled with syrup by removing the lid 55 and pouring the syrup into the container 3 through the opening 7 in the cover 5. The opening 7, being of the rectangular shape shown, presents a good target for syrup entry, and reduces the possibility of spillage; but if any syrup is spilled in being poured into the container, it is collected in the channel 9 and flows down and is collected in the low zone of the channel at **9*d*. If more syrup is spilled than can be collected in the channel 9, it cannot enter the container because the flange 45 is higher than the flange 47, and spills over the flange 47 at the front 25 of the container, running down the front of the container to the floor of the vendor on which the container rests. Since the spillage is at the front, the container and floor may be readily cleaned without having to take the container out of the vendor. The cover 5 may be readily removed for cleaning without having to remove the syrup line, the auxiliary cover member 11 remaining in place on the container. The fact that the cover 5** may be removed without having to disconnect the syrup line encourages the sanitation of the cover.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A tank comprising a container open at the top and a cover for the top having an opening therein for pouring a liquid into the container, the cover also being formed with a channel surrounding said opening for collecting liquid being poured which misses said opening to prevent such spillage from running down the outside of the container to the floor, and said cover being removable from the container for pouring out the collected spillage and cleaning the cover, said cover covering part of the top of the container and constituting the main cover of the tank, the remainder of the top of the container being covered by an auxiliary cover member having a pick-up tube extending downwardly therefrom into the container and means for connecting a line to the tube for drawing liquid out of the container, said auxiliary cover member along with said pick-up tube being removable from the container, the main cover being removable without removing the auxiliary cover member.

2. A tank comprising a container open at the top and a cover for the top having an opening therein for pouring a liquid into the container, said cover having an upwardly extending inner flange surrounding said opening, an upwardly extending outer flange surrounding said inner flange, and a downwardly extending flange interfitting said container, said inner and outer flanges in conjunction with the portion of the cover between said inner and outer flanges defining a channel surrounding said opening for collecting liquid being poured which misses said opening to prevent such spillage from running down the outside of the container to the floor, said cover being removable from the container for pouring out the collected spillage and cleaning the cover, the inner flange being higher than the outer flange to preclude liquid collected in the channel from spilling over into the container.

3. A tank as set forth in claim 2 having a lid fitting on the inner flange.

4. A tank as set forth in claim 2 wherein a portion of the cover between the flanges constituting the bottom of the channel is sloped for flow of liquid collected in the channel to a portion of the channel at one side of the cover.

5. A tank comprising a container open at the top and a cover for the top having an opening therein for pouring a liquid into the container, the cover also being formed with a channel surrounding said opening for collecting liquid being poured which misses said opening to prevent such spillage from running down the outside of the container to the floor, and said cover being removable from the container for pouring out the collected spillage and cleaning the cover, the channel being formed by an inner flange extending up from the cover around said opening and an outer flange extending up from the cover at its periphery, the inner flange being higher than the outer flange to preclude liquid collected in the channel from spilling over into the container, a portion of the cover between the flanges constituting the bottom of the channel being sloped for flow of liquid collected in the channel to a portion of the channel at one side of the cover, said cover covering part of the top of the container and constituting the main cover of the tank, the ramainder of the top of the container being covered by an auxiliary cover member having a pick-up tube extending downwardly therefrom into the container and means for connecting a line to the tube for drawing liquid out of the container, said auxiliary cover member along with said pick-up tube being removable from the container, the main cover being removable without removing the auxiliary cover member.

6. A tank as set forth in claim 5 wherein the container is rectangular, the auxiliary cover member being located at a corner of the container, the cover having four sides at the four sides of the container and a fifth side at said corner.

7. A tank as set forth in claim 6 wherein the opening in the cover is rectangular and the channel thereby has four portions along said four sides.

8. A tank as set forth in claim 7 wherein the channel is sloped for flow of liquid in the channel to the portion of the channel at one side of the cover.

9. A tank as set forth in claim 7 wherein said one side of the cover is a side away from said corner.

* * * * *